US012029267B2

(12) United States Patent
Mert et al.

(10) Patent No.: US 12,029,267 B2
(45) Date of Patent: Jul. 9, 2024

(54) GARMENT HAVING AN OVERLOCK STITCH AND THE RELATED PRODUCTION PROCESS

(71) Applicant: Sanko Tekstil Isletmeleri San. Ve Tic. A.S., Inegol-Bursa (TR)

(72) Inventors: Serkan Mert, Inegol-Bursa (TR); Dilara Yurdagul, Inegol-Bursa (TR); Gizem Nur Temir, Inegol-Bursa (TR)

(73) Assignee: SANKO TEKSTIL ISLETMELERI SAN. VE TIC. A.S., Inegol-Bursa (TR)

( * ) Notice: Subject to any disclaimer, the term of this patent is extended or adjusted under 35 U.S.C. 154(b) by 227 days.

(21) Appl. No.: 17/620,812

(22) PCT Filed: Jun. 29, 2020

(86) PCT No.: PCT/EP2020/068276

§ 371 (c)(1),
(2) Date: Dec. 20, 2021

(87) PCT Pub. No.: WO2020/260703

PCT Pub. Date: Dec. 30, 2020

(65) Prior Publication Data

US 2022/0338574 A1 Oct. 27, 2022

(30) Foreign Application Priority Data

Jun. 28, 2019 (EP) ..... 19183448

(51) Int. Cl.
*A41D 27/24* (2006.01)
*D05B 1/20* (2006.01)

(52) U.S. Cl.
CPC ..... *A41D 27/24* (2013.01); *D05B 1/20* (2013.01)

(58) Field of Classification Search
CPC ..... A41D 27/24; D05B 1/20; D05B 1/00–26
See application file for complete search history.

(56) References Cited

U.S. PATENT DOCUMENTS 1,612,819 A * 1/1927 Huber ..... D05B 3/02 112/475.26
1,992,680 A 2/1935 Talmadge
(Continued)

FOREIGN PATENT DOCUMENTS

DE 3639390 A1 * 7/1987
EP 2 143 347 1/2010
(Continued)

OTHER PUBLICATIONS

International search report and written opinion issued on Oct. 6, 2020 for PCT/EP2020/068276.

*Primary Examiner* — Ismael Izaguirre

(57) ABSTRACT

It is disclosed a garment (1) having an inner side (1*a*), and an outer side (1*b*) opposite to the inner side (1*a*), the garment (1) comprising one or more woven fabrics (2, 3), wherein at least two ends (2*a*, 3*a*) of different woven fabrics (2, 3) and/or two ends (2*a*, 3*a*) of the same woven fabric are seamed by means of one or more threads (4*a*) that form a stitch (4), wherein said stitch (4) is an overlock stitch (4) and it is arranged so that at least one of said thread (4*a*) is present on the inner side (1*a*) of the garment (1), and at least one of said thread (4*a*) is present on the outer side (1*b*) of the garment (1), the thickness (T1) of the stitch (4) on the inner side (1*a*) of the garment (1) is less than the thickness (T2) of the stitch (4) on the outer side (1*b*) of the garment (1).

20 Claims, 15 Drawing Sheets

(56) References Cited

U.S. PATENT DOCUMENTS

| | | | | | |
|---|---|---|---|---|---|
| 2,141,239 | A * | 12/1938 | Diamond | A41D 27/24 | 112/414 |
| 3,246,337 | A * | 4/1966 | Copeland | A41D 27/24 | 2/2.15 |
| 3,246,621 | A * | 4/1966 | Copeland | A41D 27/24 | 428/102 |
| 4,625,336 | A | 12/1986 | Derderian | | |
| 9,968,147 | B1 * | 5/2018 | Lindquist | A41D 27/204 | |
| 10,309,046 | B2 * | 6/2019 | Konno | D05B 93/00 | |
| 2013/0084777 | A1 | 4/2013 | Starr et al. | | |
| 2013/0189498 | A1 | 7/2013 | Akaishi | | |

FOREIGN PATENT DOCUMENTS

| | | |
|---|---|---|
| EP | 2 985 378 | 2/2016 |
| EP | 3287107 | 2/2018 |
| WO | 98000595 | 1/1998 |

* cited by examiner

GARMENT HAVING AN OVERLOCK STITCH AND THE RELATED PRODUCTION PROCESS

This application is a U.S. national stage of PCT/EP2020/068276 filed on 29 Jun. 2020, which claims priority to and the benefit of European Patent Application No. 19183448.0, filed 28 Jun. 2019 the contents of which are incorporated herein by reference in their entireties.

TECHNICAL FIELD

The present invention relates to the field of woven fabrics, and of garments (at least partially) obtained from woven fabrics.

BACKGROUND

It is known to cut one or more fabrics and to join the ends of the resulting pieces to produce a garment, by means of stitches. The stitch types that are used for joining fabric pieces provide garments have that have a stiff "hand" and "feel", i.e. they result in an uncomfortable wearing experience for end users. This is particularly true for leggings, or "skinny type" garments which are worn tightly on the user.

Overlock stitches are known, that are used mainly for joining knitted fabrics. Some examples of pieces of woven fabric(s) joined by means of overlock stitches are e.g. known in the art.

EP 3287107 A1 discloses a stretchable garment with varying compression characteristics. The description mentions that various seam types may be used, i.e. lock stitch, chain stitch, safety stich, surging stitch, overlapped stitch, zigzag stitch, cover stitch, blind stitch, flat lock stitch, heat seam seal with an adhesive tape, ultrasonic welding, laser welding. Further to those seams, an overlock (merrow) stitch is mentioned.

US2013189498 relates to a woven fabric having a frill used for manufacture of a garment having a frill. The frill is added to the base cloth via overlock (merrow) stitches.

US2013084777 relates to the field of brasseries. An overlock (merrow) stitch may be used to join the borders of the woven fabric used to produce the relevant garment.

SUMMARY OF THE INVENTION

An object of the present invention is to provide a garment that is comfortable for the user, in particular a comfortable tight garment.

It is also another object of the invention to provide a garment that is easy and fast to produce.

These and other objects are achieved by means of the present invention according to one or more of the enclosed claim.

An aspect of the invention relates to a garment according to claim 1.

In particular, according to an aspect, a garment has an inner, and an outer side opposite to the inner side. The garment comprises one or more woven fabrics, and at least two ends of different woven fabrics and/or two ends of the same woven fabric are seamed by means of a stitch. The stitch is an overlock stitch and it is arranged so that at least one of said thread is present on the inner side of the garment, and at least one of said threads is present on the outer side of the garment. The stitch is arranged so that the thickness of the stitch on the inner side of the garment is less than the thickness of the stitch on the outer side of the garment.

As known, the "inner" side of a garment is the one that, in use, is directed towards a user (i.e. faces the wearer), while the "outer" side is the opposite one.

The "thickness" of the stitch may be the height of the stitch measured from the surface of the relevant side of the fabric, i.e. a measure of how much the stitch protrudes from the surface of the garment.

Typically, the stitch has a greater thickness on the side of the garment where the connections between the threads of the stitch (or different parts of a thread of the stitch) are placed. In fact, in general, after the ends of the fabric(s) are arranged in a side by side configuration, i.e. facing one another, only on one side of the garment (the outer side in the present solution) the threads (or part of a thread) are connected one another. In other words, in the thicker side of the stitch, different portions of the thread(s) of the stitch cross, i.e. floats over or superimpose, one over the other, so that a portion of a thread of the stitch crosses, i.e. floats over (typically in a substantially perpendicular manner) another portion of a thread of the stitch.

Typically, the portions of the thread(s) that are placed on the opposite side of the garment (the inner side of the present solution) are arranged substantially parallel one to another. As a result, a preferred way to evaluate which is the side of the garment having a stitch with the greater thickness, is to check which is the side where different portions of thread(s) of the stitch cross over, i.e. superimpose, one another. In other words, in a stitch according to the invention typically there is a first side of the garment where the portions of the thread(s) of the stitch are arranged adjacent, e.g. substantially parallel, one to the other; on the second side of the garment (i.e. the one opposite to the first side) different portions of the thread(s) of the stitch cross over (or float over) one another: In this configuration the second side of the garment may be identified as the side having a stitch with the greater thickness and is the side that in the garment is the inner side.

The two ends of the fabric(s) are preferably arranged one next to the other, in a "side-by-side" configuration, so as not to overlap one above the other. In possible embodiments there typically may be a distance between the ends of the woven fabric(s); the distance may be measured along a direction parallel to the surface of the garment (considered in a condition where the two ends of the garment lie on a plane surface).

When an overlock stitch is applied to seam two ends of a fabric portion (or ends of two or more different fabrics), and the ends are subsequently arranged in a "side-by-side" configuration (e.g. by pulling the fabric ends), there is one side of the fabric(s) where the stitch has a greater thickness. In the present solution, the stitch is arranged so that, the side of the fabric where the stitch has greater thickness is the outer side of the final garment.

Overlock stitches (also known as overedge stitches) are known to the skilled person. It is in fact known to classify the kinds of stitches. As an example, ASTM D6193 divides the stitches in different classes. Overlock stitches are classified in class 500 of ASTM D6193.

Overlock stitches are seldom applied to woven fabrics. Thanks to the overlock stitch in "reverse" configuration (i.e. with the "thinner" side in contact with the skin of the user), the end user feels a soft seam even when they wear tight fit garments. In fact, when the stitch is made in "reverse" configuration, the stitches are substantially at the same level of fabric(s) ends, so that there is substantially no increased thickness at the seam(s).

In addition to the comfort provided to the user, thanks to the present solution, the stitching operation is done at once, while common commercial stitch type used in the field (e.g. flat lock stitches) are completed in two operations. This gives an efficiency increase on production of products as well. Also, thread consumption is three times less then e.g. flat lock stitches.

According to an aspect, the overlock stitch is a two threads overlock stitch or, more preferably, a three threads overlock stitch. In particular, according to an aspect, the stitch is the stitch 504 of ASTM D-6193. According to an aspect, the garment is elastic, i.e. is made of an elastic fabric; preferably it may be a pair of trousers.

According to an aspect, the garment comprises one or more fabrics that are seamed via a plurality of stitches. According to another preferred aspect, at least 50%, more preferably at least 80%, most preferably all the stitches of the garment are overlock stitches that are arranged so that the thickness of the stitch is greater on the outer side with respect to the inner side of the garment.

The present invention also relates to a method for producing a garment, comprising the steps of: providing one or more woven fabrics; tailoring the one or more woven fabrics in the shape of a garment. In particular, in the latter step, at least two ends of two woven fabrics, or two ends of the same woven fabric, are seamed by means of an overlock stitch, that is arranged so that at least one of said thread is present on the inner side of the garment, and at least one of said thread is present on the outer side of the garment, the thickness of the stitch on the inner side of the garment is less than the thickness of the stitch on the outer side of the garment.

According to an aspect, the two ends are initially (at least in part) superimposed, i.e. they overlap at least in part, to provide the overlock stitch. Typically, the two ends are then moved along opposite directions that are angled, preferably perpendicularly, with respect to the stitch direction, until the ends are parallel one to the other, preferably until they are arranged facing each other, in a "side-by-side" configuration.

According to an aspect, after the stitch is completed, the two ends are pulled in opposite direction, along direction that are angled, preferably perpendicularly, with respect to the stitch direction.

According to a possible solution, it is possible to perform a cutting operation on the edges of the ends where the stitch is applied. This operation can be made e.g. via a dedicate function of the relevant sewing machine, e.g. the known ones capable of applying a merrow/overedge stitch. Thanks to the cutting operation, is possible to have a regular seam margin. In addition to that, thanks to the cutting operation, the edges of the ends of the fabric(s) that are coupled according to the present solution, after finishing, present a defined and sharp look, without fraying.

Due to the low tension of the stitch, the two ends move so that there is substantially no added thickness, or a low thickness, in the area of the stitch.

BRIEF DESCRIPTION OF THE DRAWINGS

The invention will now be described in greater detail, by way of example, with reference to the accompanying non limiting drawings. It is emphasized that, according to common practice, the various features of the drawing are not necessarily to scale. On the contrary, the dimensions of the various features are arbitrarily expanded or reduced for clarity. Like numerals denote like features throughout the specification and the drawings in which:

FIGS. 3A-8A are schematic views of a stitch according to an embodiment of the present invention, drawn from a similar perspective of corresponding FIGS. 3-8.

DETAILED DESCRIPTION

Figure 1A:
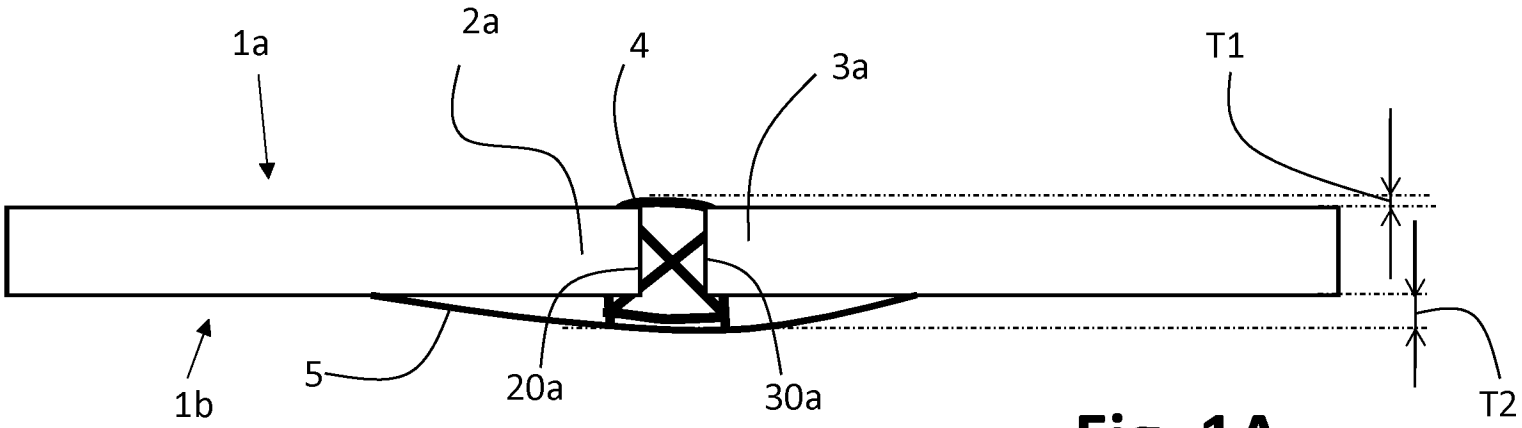
FIG. 1A is a schematic enlarged sectional view of a stitch of a garment according to an embodiment of the present invention.
Figure 1B:
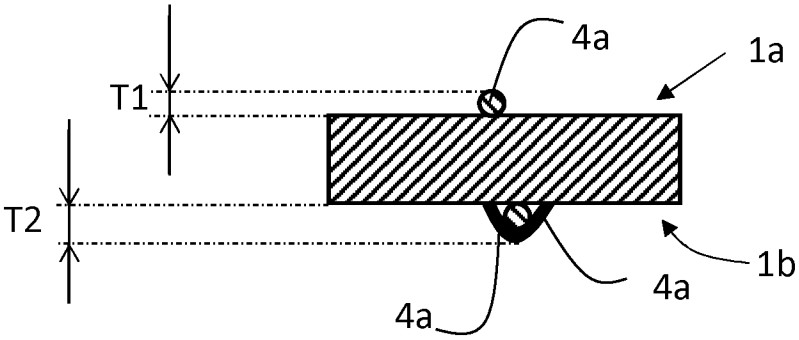
FIG. 1B is a schematic cross-section of the view of FIG. 1.

A garment 1 is provided with an inner side 1*a*, and an outer side 1*b*. The inner side 1*a*, in use, is towards the user, preferably in contact with the skin of a user. The outer side 1*b*, as a consequence, is the opposite side with respect to the inner side 1*a*.

The garment 1 comprises one or more woven fabrics 2, 3. As known, in order to produce a garment, ends 2*a*, 3*a* of one or more fabrics 2, 3 are joined to provide a garment 1. In particular, one fabric may be bent so that some of its ends (i.e. end portions) are (at least in part) overlapped, or ends of different fabrics may be partially overlapped to be subsequently joined. For easiness, the following description will discuss the joining of two ends 2*a*, 3*a* of different fabrics 2, 3. However, the following description applies also to ends 2*a*, 3*a* of the same fabric.

As known, a common way to join the ends 2*a*, 3*a* is by applying a stitch 4, i.e. a via a so called stitching operation. During stitching, one or more threads 4*a* are passed alternatively up and down through both the ends 2*a*, 3*a*.

Different kinds of stitches 4 are known in the art. The stitches used in the present invention are known as overlock or overedge stitches, i.e. stitches wherein, when applied to the ends, the thread(s) 4*a* pass over the ends 2*a*, 3*a* of the fabric(s). These stitches were originally applied mainly by sewing machines of the Merrow company. As a result, these kinds of stiches are also known as "merrow stitches".

It is known to classify the stitches, and to divide the stitches in different class. Overlock stitches are commonly e.g. classified as class 500 in ASTM D-6193. It is also common to divide the overlock stitches in different groups, according to the number of different threads 4*a* that are used in the stitch.

Preferred embodiments of the invention use overlock stitches with two or three threads, more preferably overlock stitches that use three threads.

A preferred stitch 4 is the one known as stitch 504 in ASTM D-6193.

A particular aspect of the present invention is that the stitch 4 has a thickness T1 on the inner side 1*a* of the garment 1 that is less than the thickness T2 on the outer side 1*b* of the garment 1.

The thicknesses T1 and T2 are measured from the surface of the inner/outer side 1*a*, 1*b* of the garment 1 surrounding the stitch 4, and more in detail from the surface of the garment to the higher point of the stitch 4.

Figures 2A, 2B, 2C:
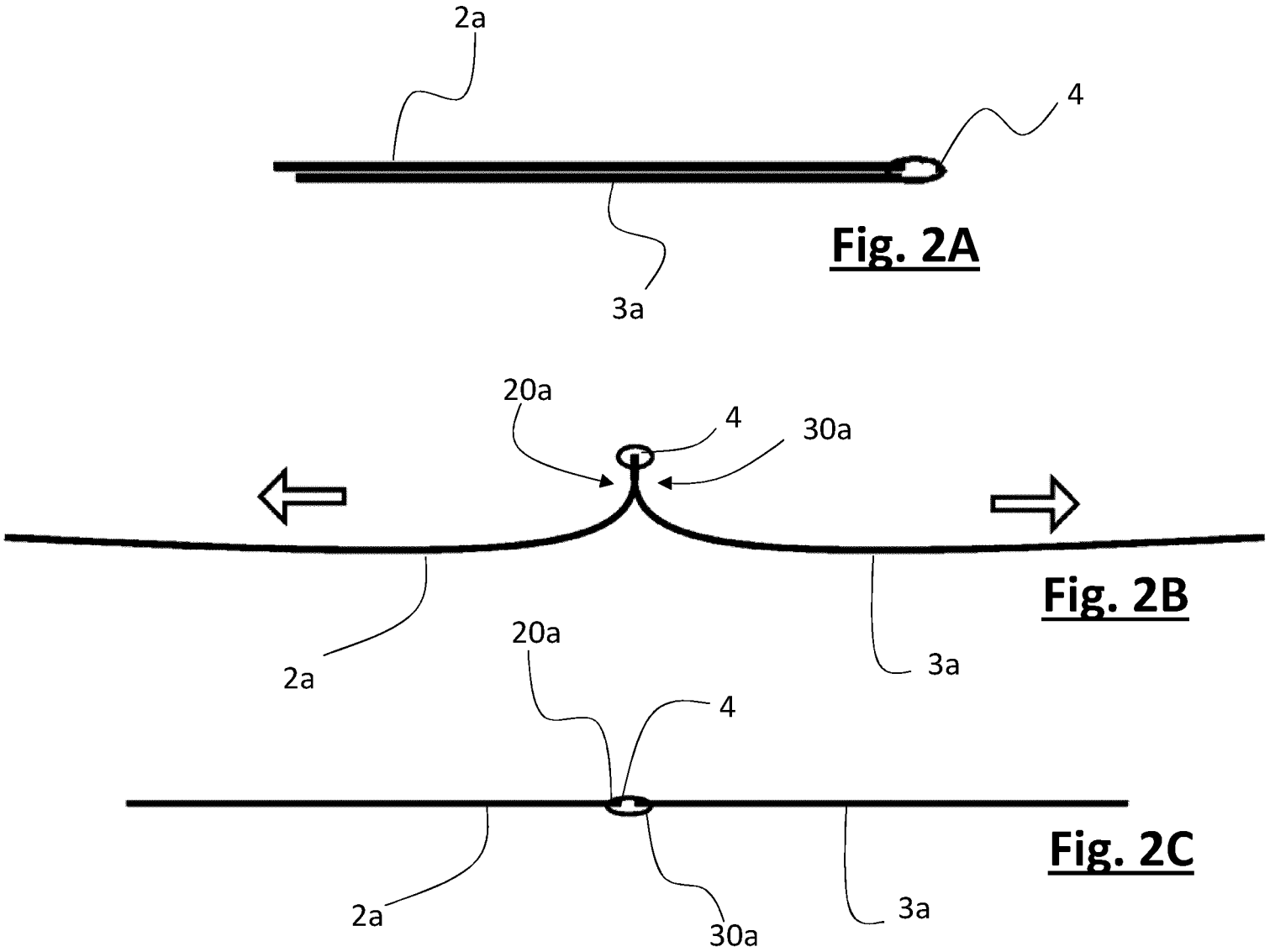
FIGS. 2A, 2B and 2C are schematic views of subsequent steps for the production of an embodiment of a garment according to the present invention.
Figure 3:
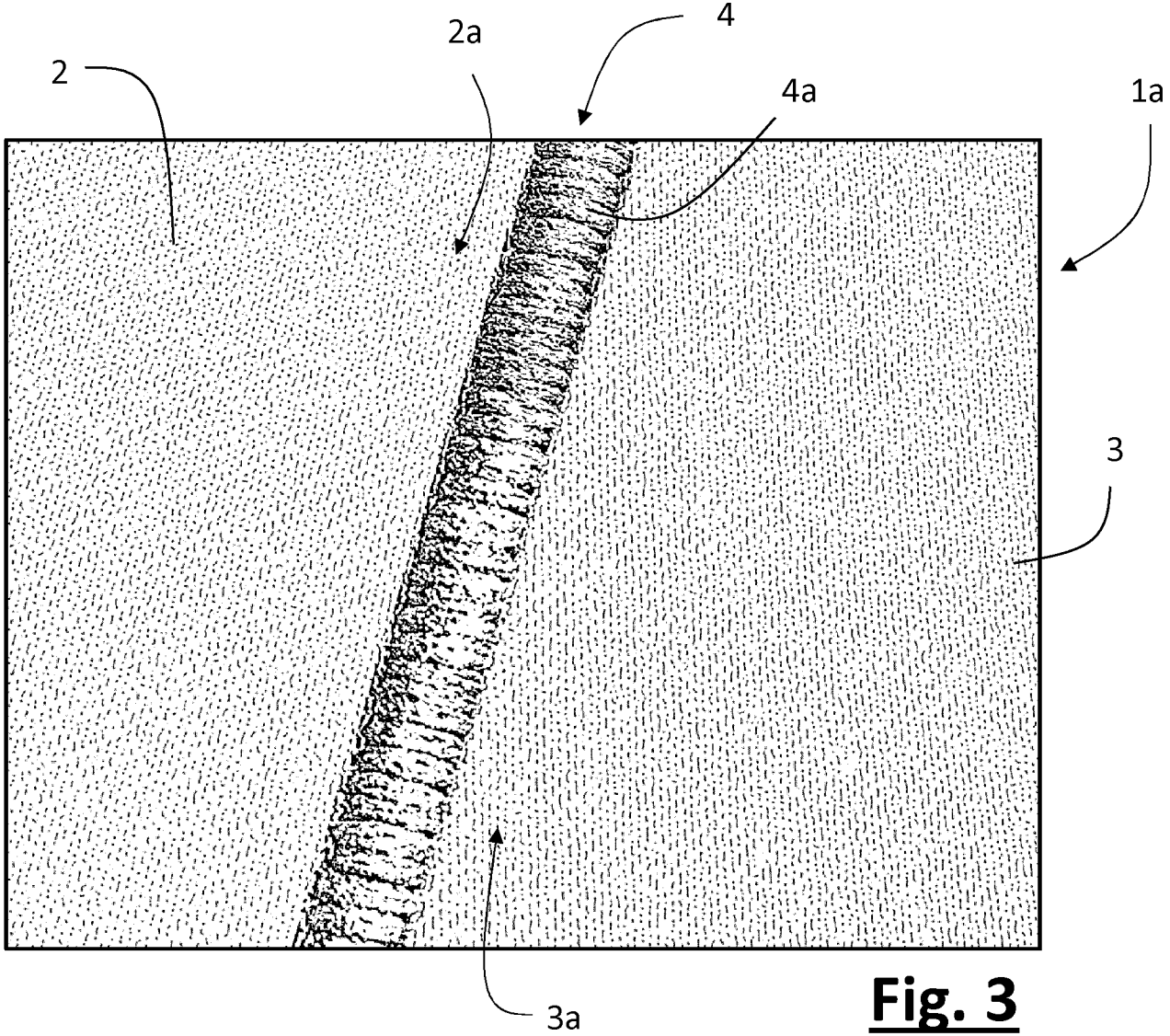
FIG. 3 is a plant view of a detail of the inner side of a garment according to an embodiment of the present invention.
Figure 3A:
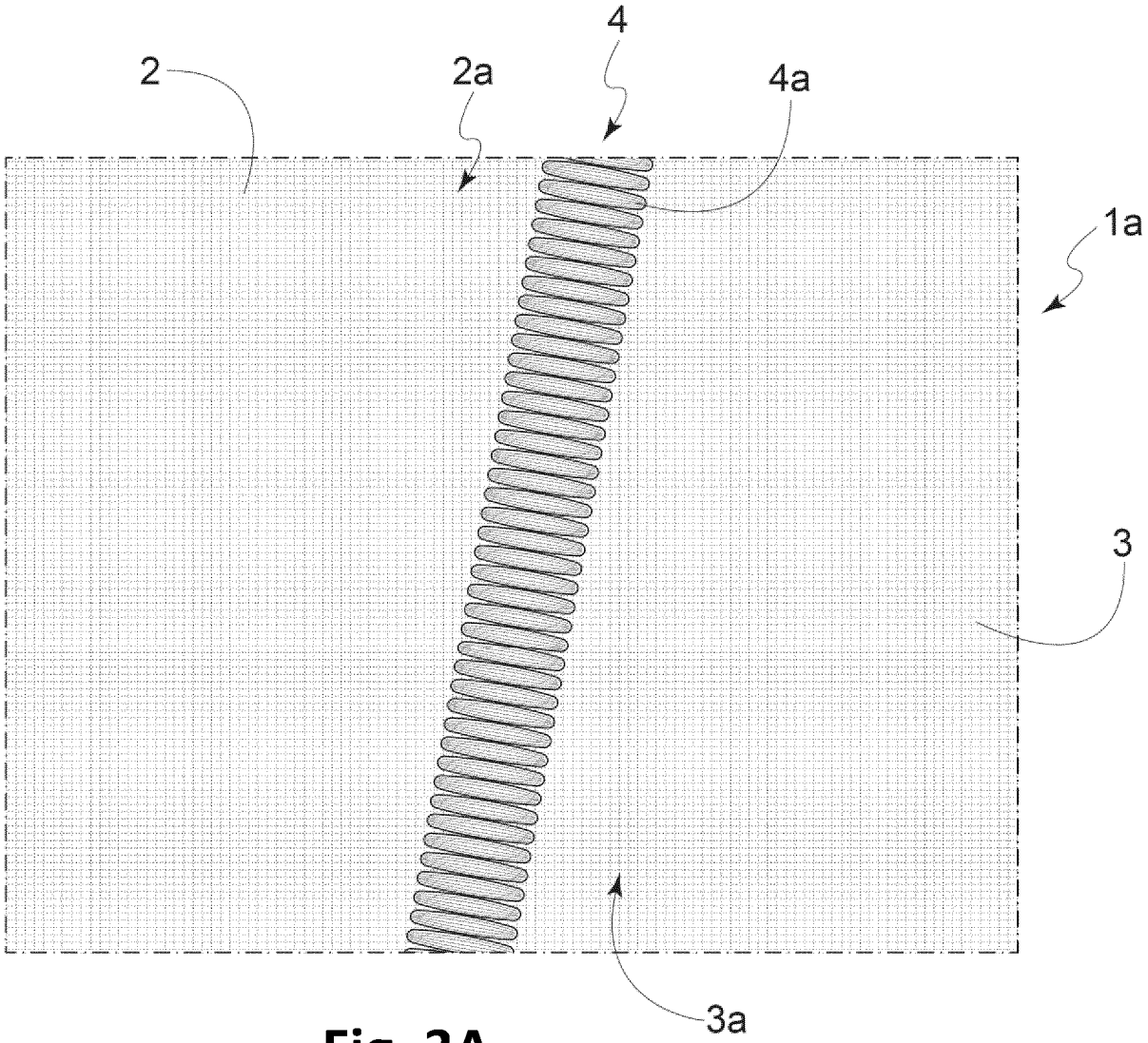
Figure 4:
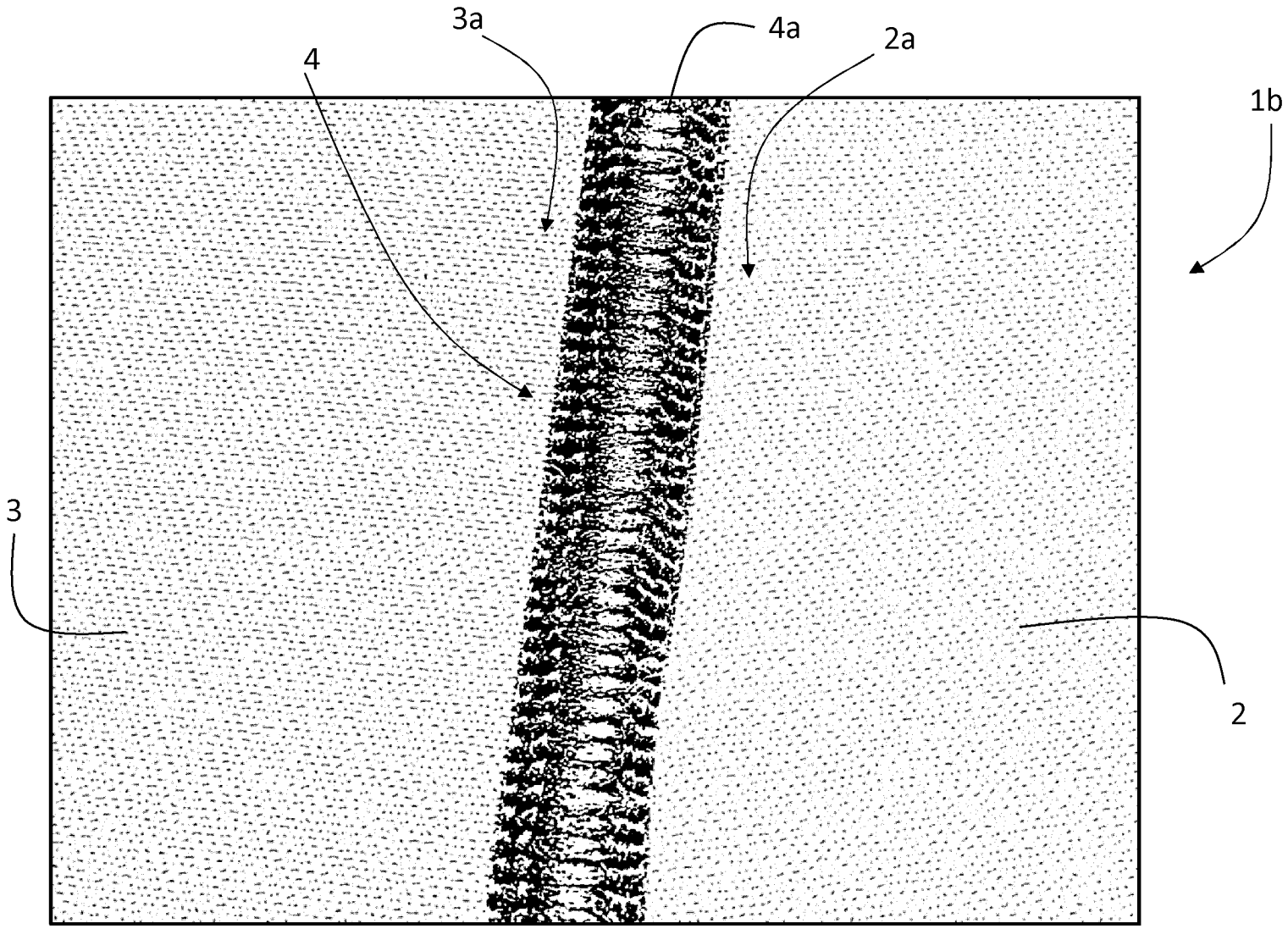
FIG. 4 is a plant view of the outer side of the garment of FIG. 3.
Figure 4A:
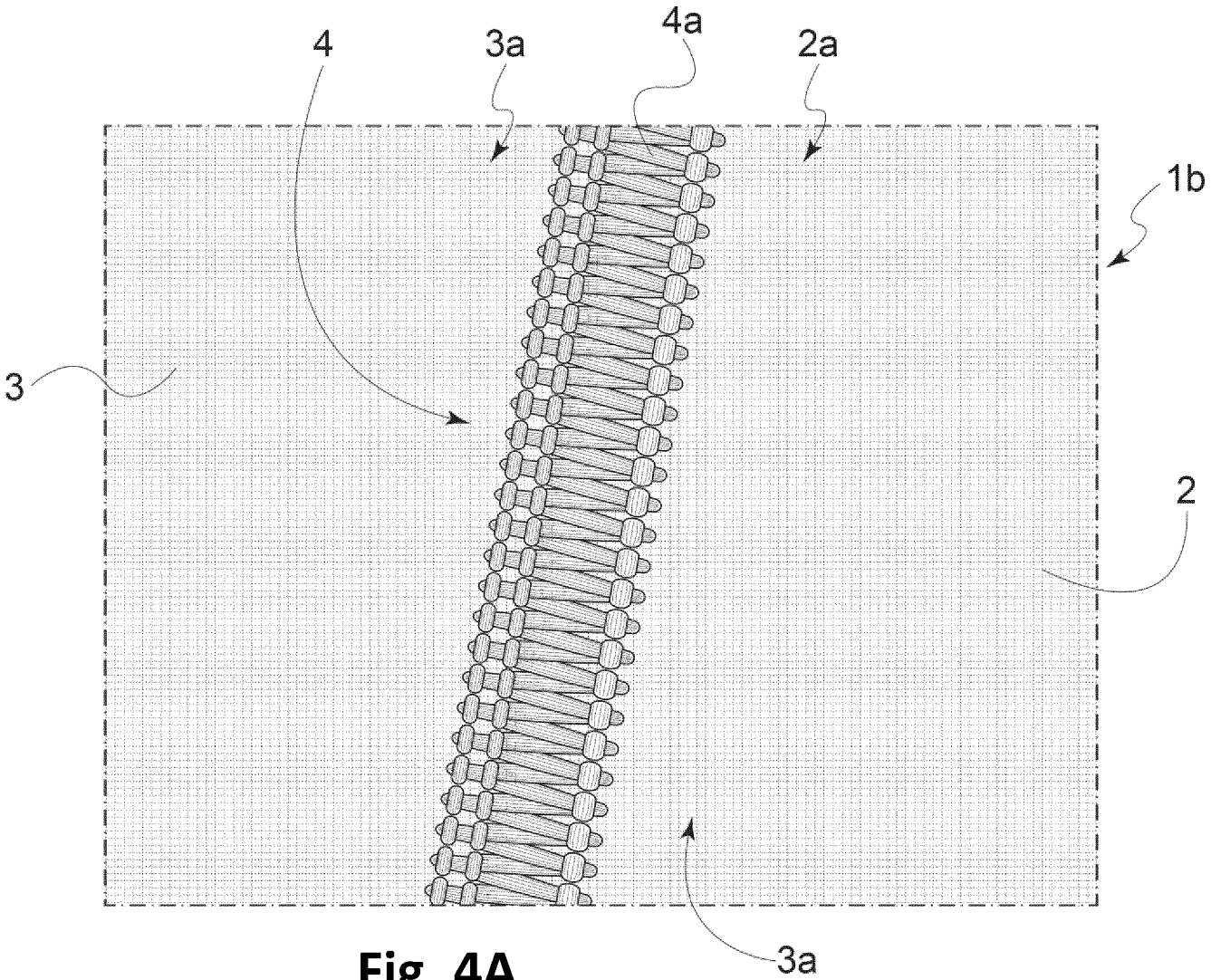
Figure 5:
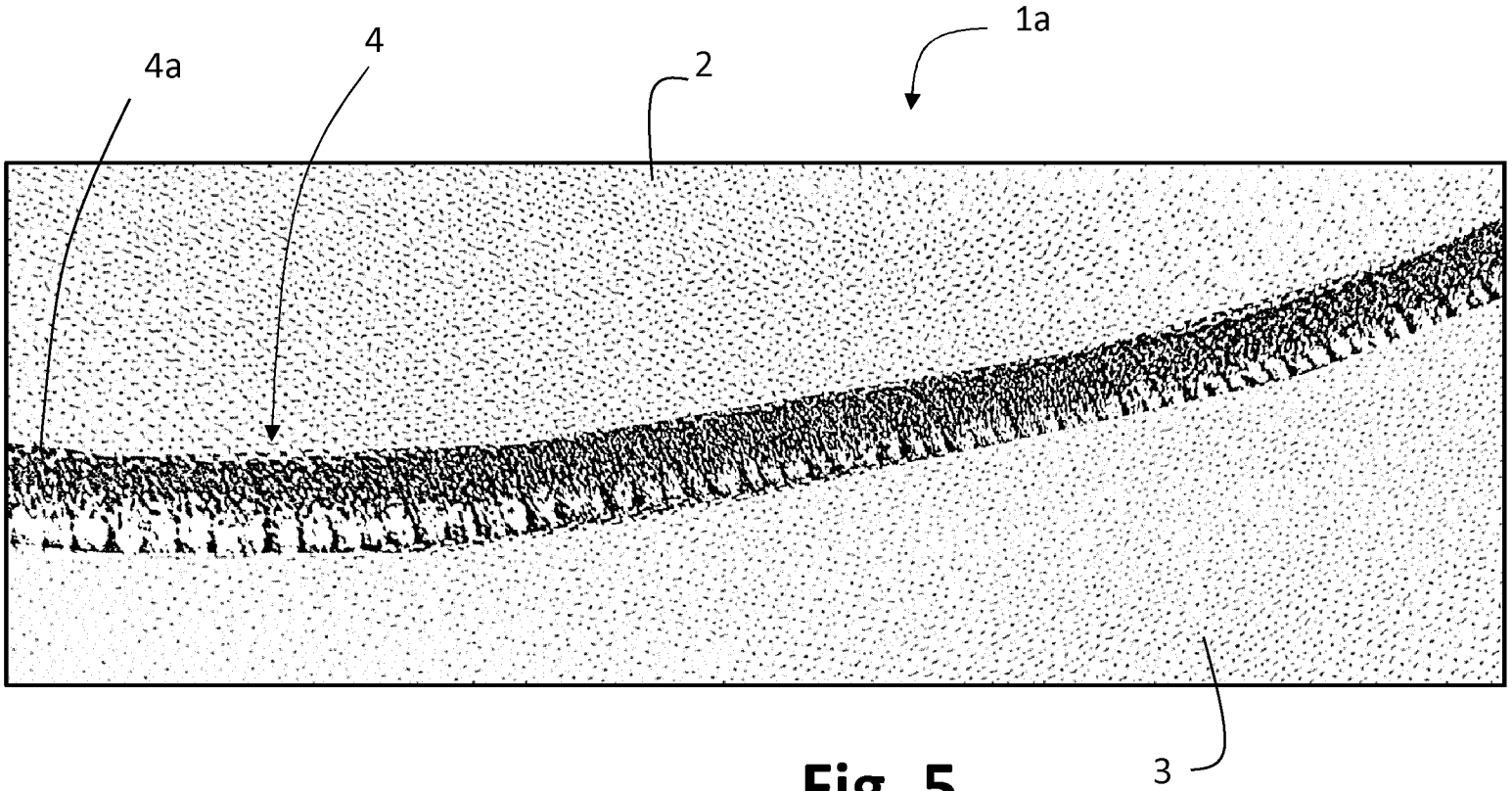
FIG. 5 is a perspective view of the inner side of the garment of FIG. 3.
Figure 5A:
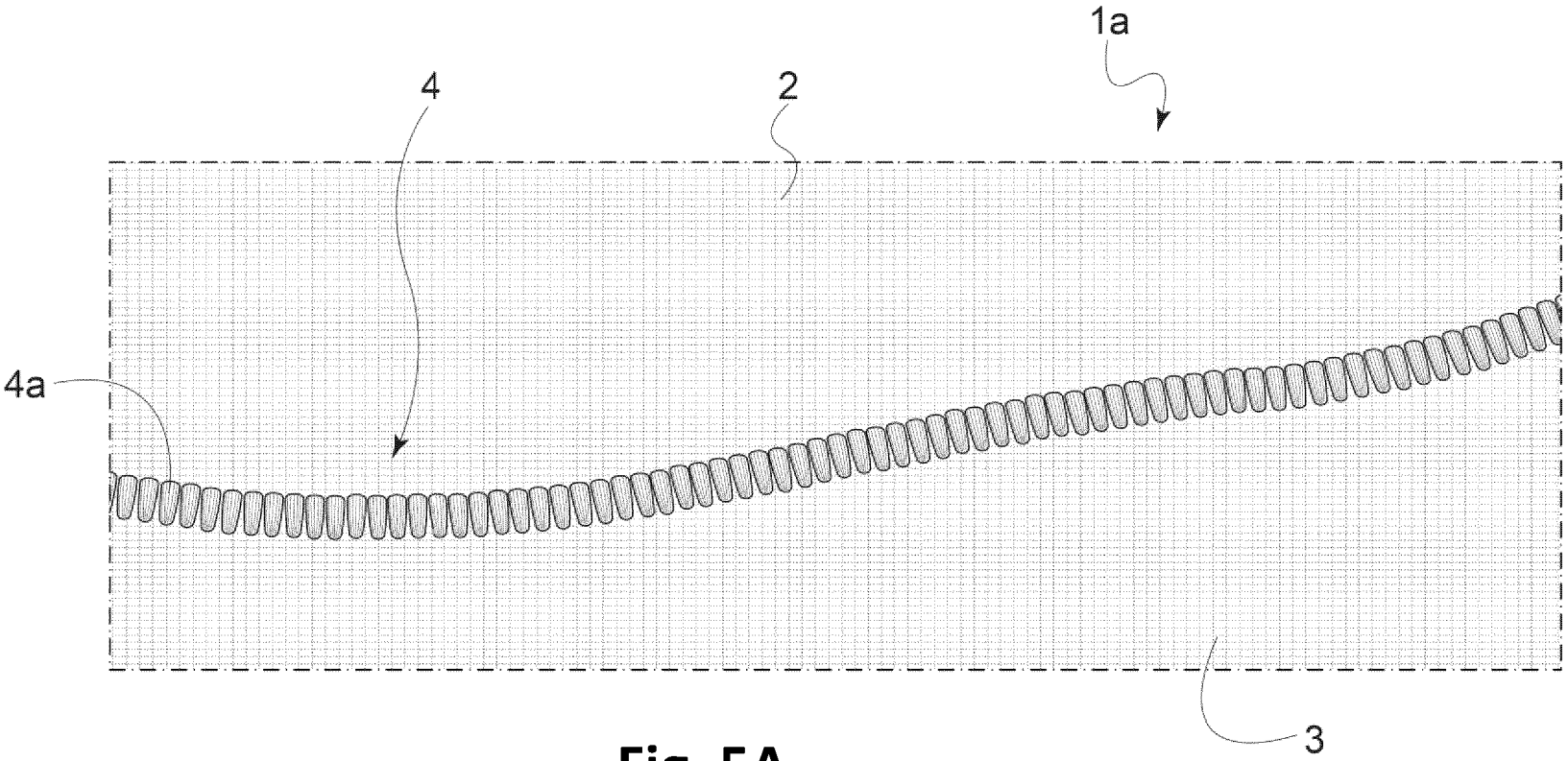
Figure 6:
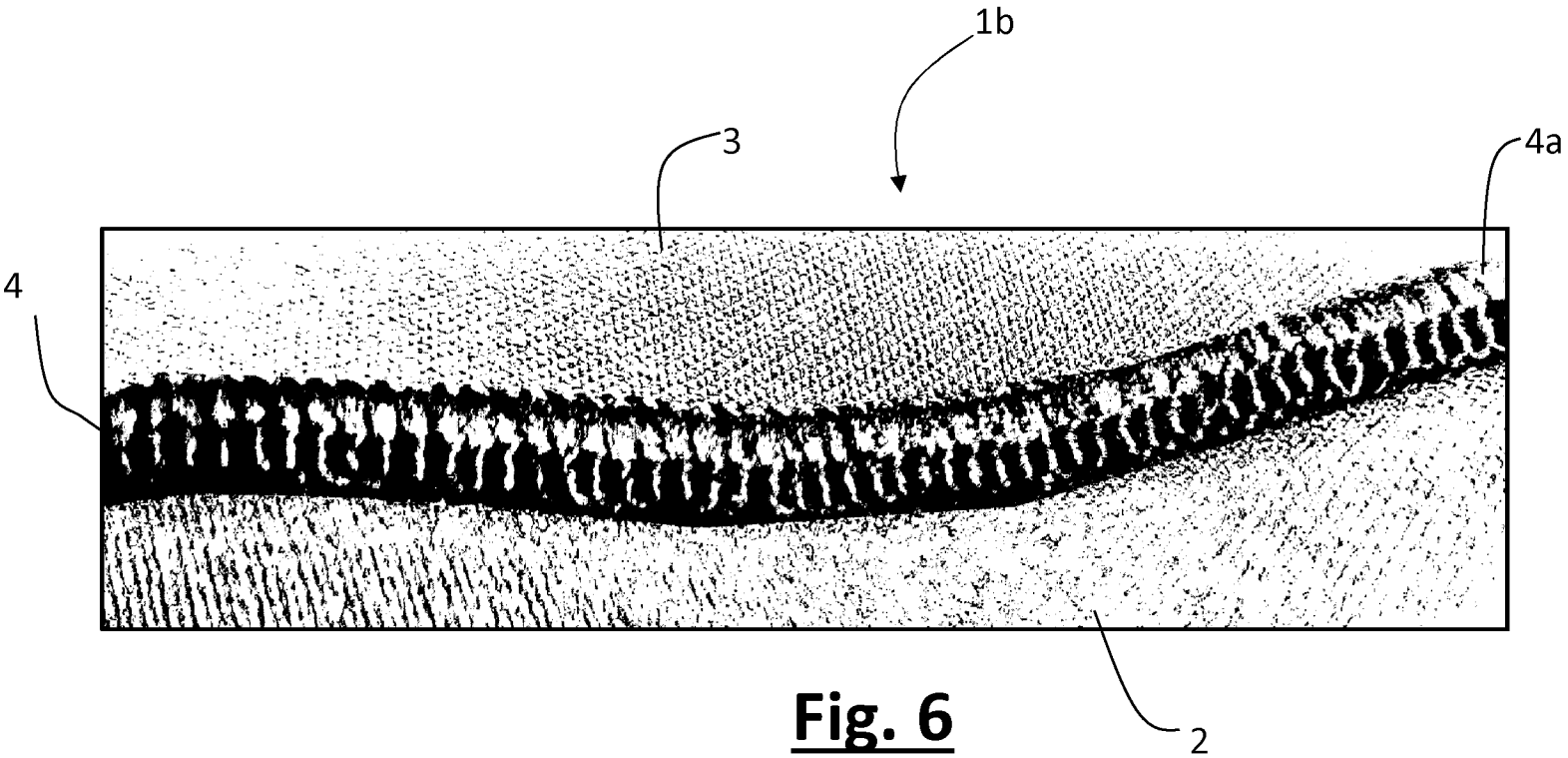
FIG. 6 is a perspective view of the outer side of the garment of FIG. 3.
Figure 6A:
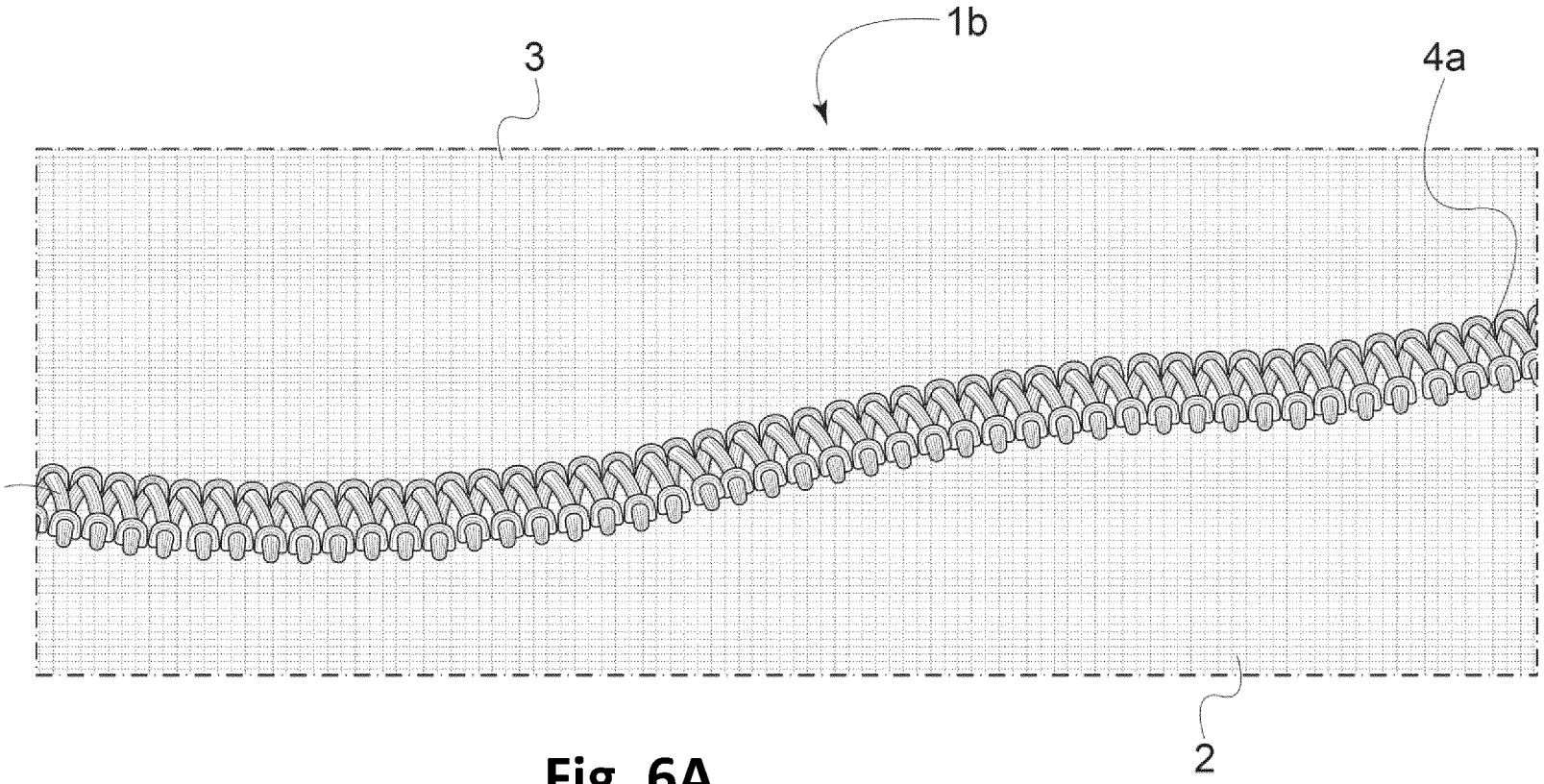
Figure 7:
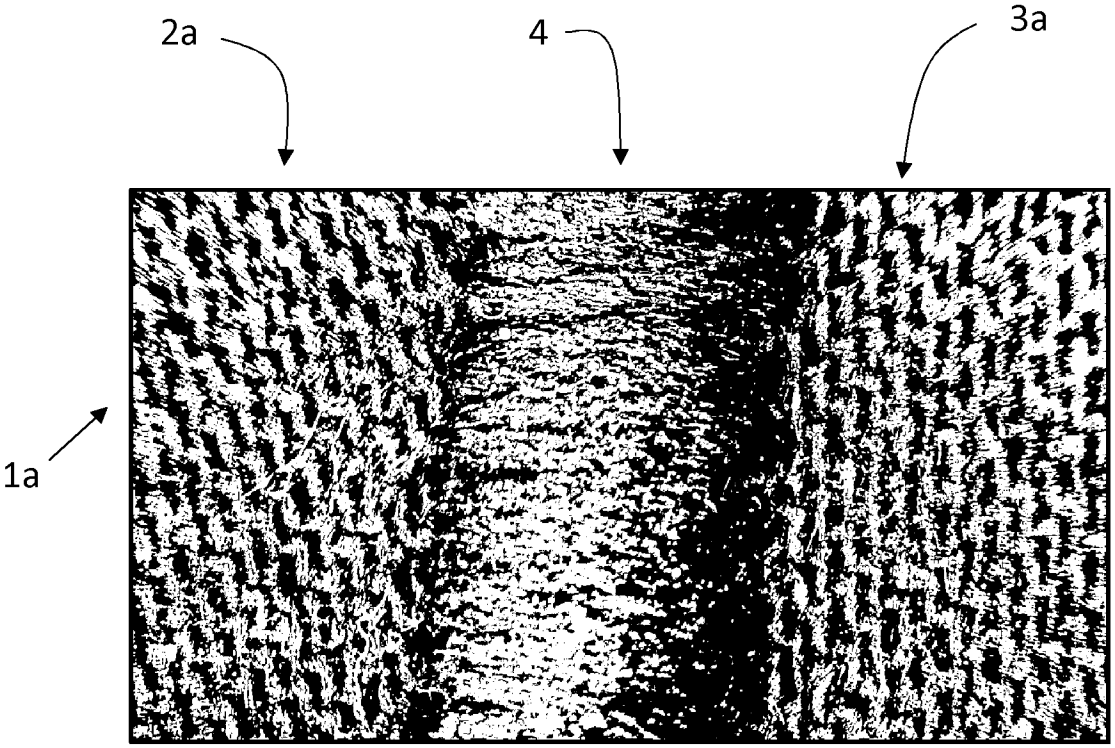
FIG. 7 is an enlarged view of the inner side of the garment of FIG. 3.
Figure 7A:
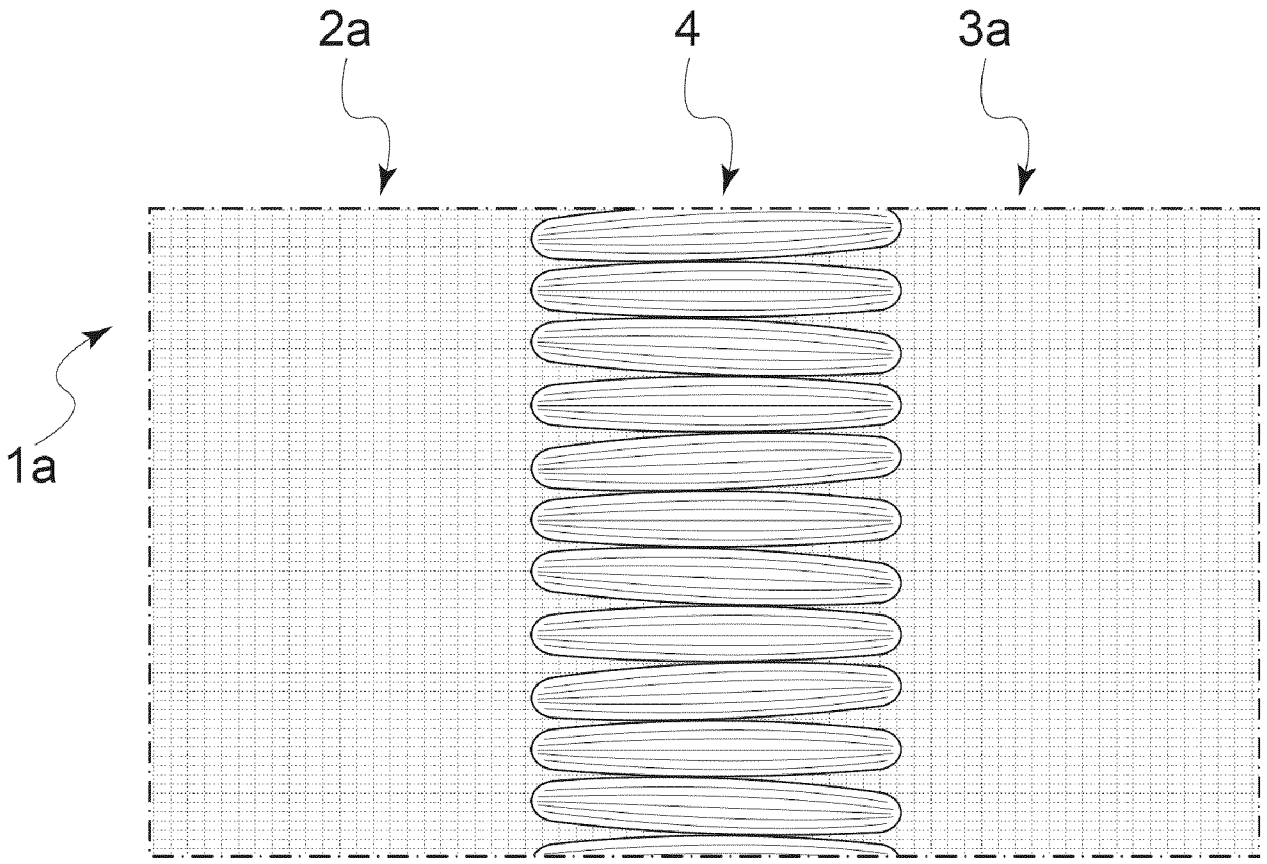
Figure 8:
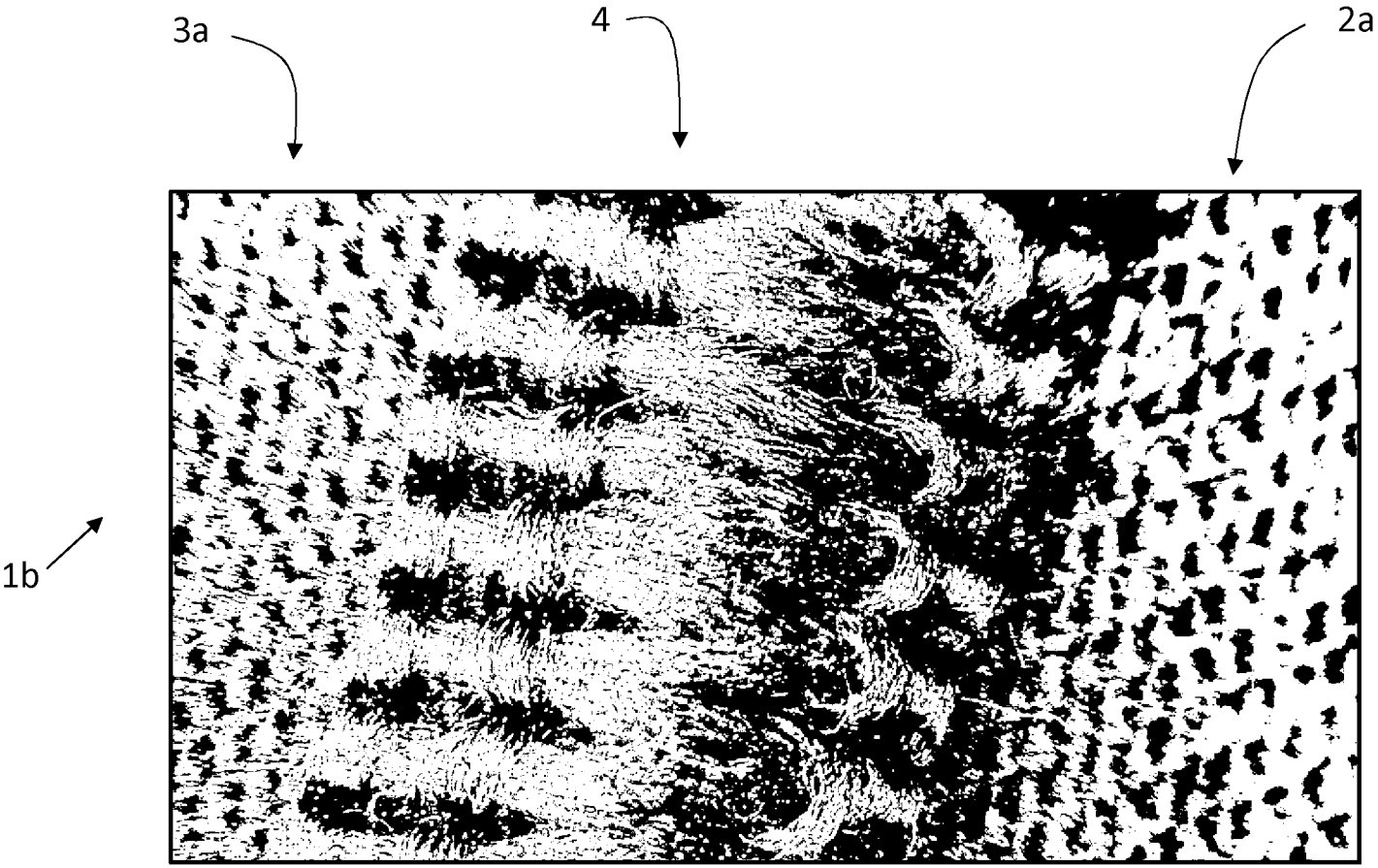
FIG. 8 is an enlarged view of the outer side of the garment of FIG. 3.
Figure 8A:
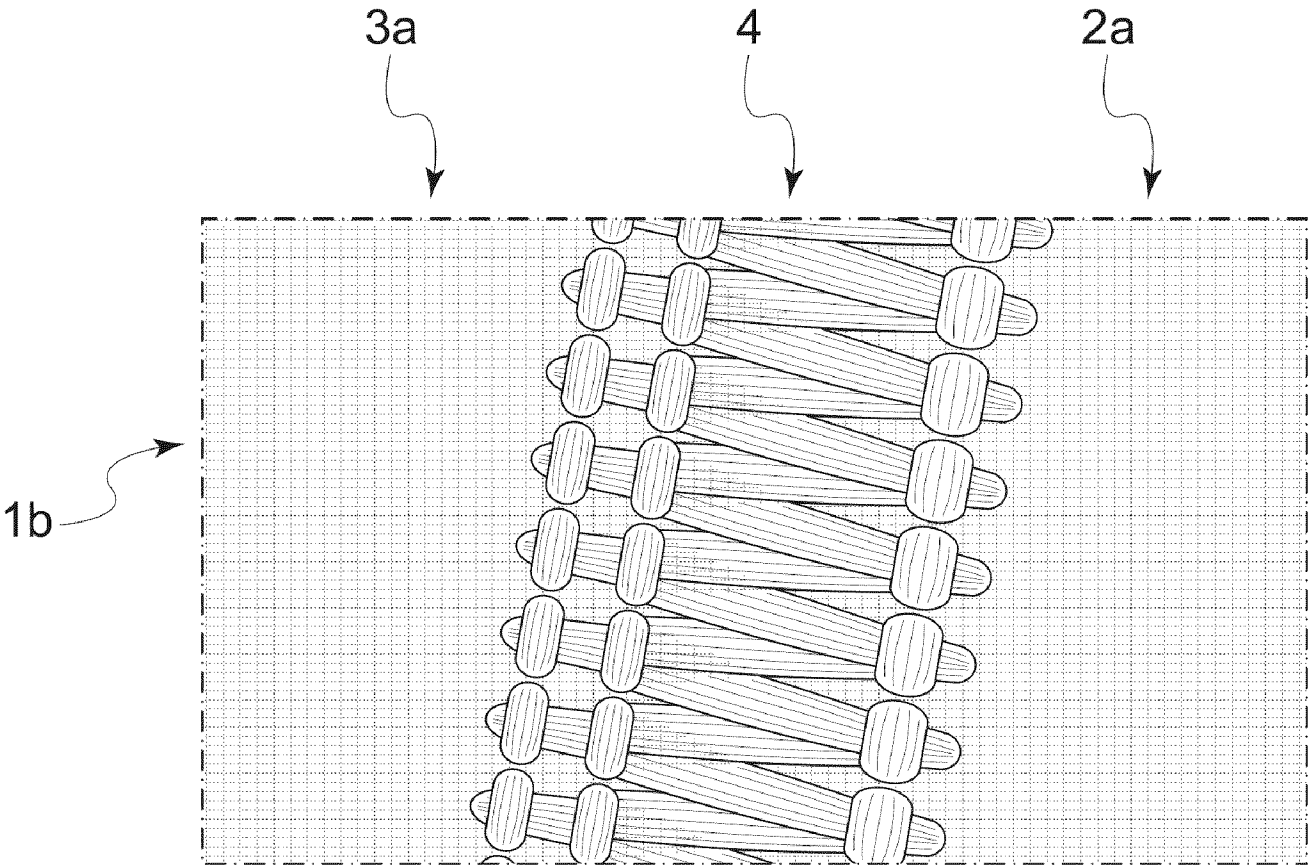
Figure 9:
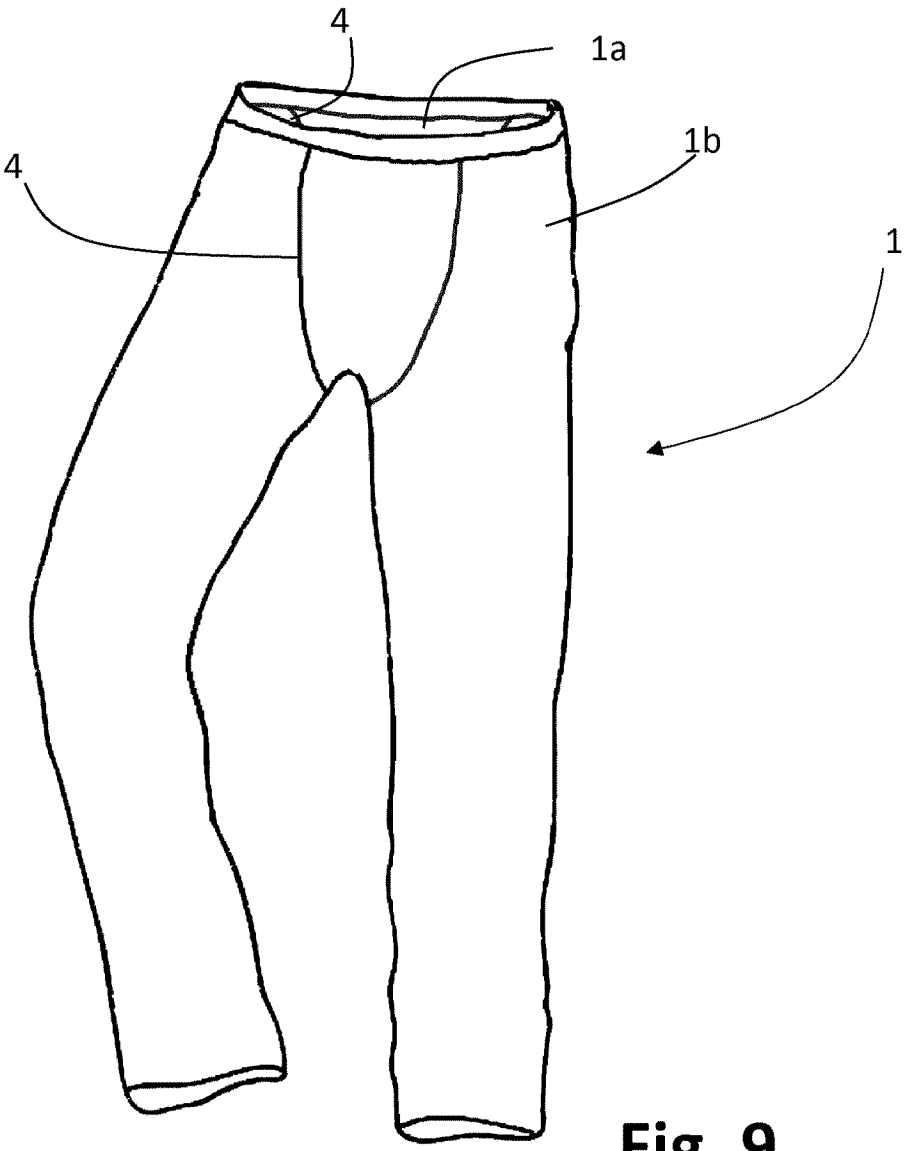
FIG. 9 is a schematic view of a garment according to an embodiment of the present invention.

It is possible to measure both thicknesses T1 and T2 because the thread(s) 4*a* of the stitch 4 is/are present on both the sides 1*a*, 1*b* of the garment 1. To obtain such an effect, according to an aspect after the stitch 4 is applied (as e.g. schematically shown in FIG. 2A), the ends 2*a*, 3*a* are moved in opposite direction (as e.g. schematically shown in FIG. 2B), i.e. they are pulled apart, perpendicularly to the direction of the stitch 4, so as to obtain the final condition, where the ends 2*a*, 3*a* are parallel, typically coplanar, as e.g. schematically shown in FIG. 2C.

According to an aspect, the thread(s) of the stitch 4, and/or different parts of a thread 4*a* of the stitch 4, are connected one to the other on the outer side 1*b* of the garment 1, e.g. via knots, loops, or similar connections, while they are not connected one to the other on the inner side of the garment 1. In other words, the knots and/or loops and/or other means that connect the different threads 4*a* of the stitch 4 (or different parts of a thread of the stitch) are present on the outer side 1*b* of the garment 1, while they are absent on the inner side 1*a* of the garment 1.

This helps in reducing the thickness T1 of the stitch 4 on the inner side 1*a* of the garment 1.

According to a preferred aspect, on the inner side 1*a* of the garment 1, the portions 4*b* of the thread(s) 4*a* that form the stitch 4 are substantially parallel one to the other. A "portion" 4*b* of a thread 4*a* is the part of a thread 4*a* that is completely and continuously outside the fabric, i.e. a part that is comprised between two subsequent points where the thread "sinks" in the fabric.

Preferably, at least 80%, more preferably at least 90%, most preferably 100% of the portions 4*b* of the thread(s) forming the stitch 4 that are placed on the inner side of the garment 1 are substantially parallel one to the other.

On the outer side of the garment 1, at least part of the portions 4*b* are angled, typically in a substantially orthogonal manner, with respect to other portions 4*b* placed on the outer side of the garment 1. As mentioned, the connection between the thread(s) of the stitch are placed on the outer side of the garment, i.e. on the outer side 1*b* of the garment 1 the portions 4*b* of the thread(s) of the stitch cross each other. In other words, on the outer side 1*b* of the garment 1, there is at least a portion of a thread that crosses and passes over another portion of a thread of a stitch. If the stitch 4 is made using two or more threads, on the outer side 1*b* of the garment 1 there is preferably a first thread passing over a second thread, crossing it, typically in a substantially perpendicular manner.

According to a possible aspect, the thickness T1 on the inner side of the garment is substantially equal to the diameter of the thread whose portions 4*b* is present on the inner side 1*a* of the garment 1. On the contrary, on the outer side of the garment 1, if the stitch uses a single thread (or threads having the same diameter) the thickness T2 of the stitch is equal or greater than twice the diameter of the thread of the stitch or, if the stitch uses different threads, is at least equal or greater than the sum of the diameter of two different threads of the stitch (i.e. the ones whose portions crosses one over the other on the outer side of the garment 1).

More in general, the thinner and the thicker sides of the stitch may be identified without the need of measuring the thickness T1, T2 of the stitch on the sides of the garment. In this scenario, the side of the stitch where the portions of the thread(s) of the stitch do not cross (or float) over one another is the thinner side of the stitch, has thickness T1 and is located on the inner side of the garment. The side of the stitch where the portions of the thread(s) of the stitch cross (or float) over one another is the thicker side of the stitch, has thickness T2 and is located on the outer side of the garment portions of the thread(s). The thickness T2 of the stitch in the outer side of the garment is greater than the thickness T1 of the stitch on the inner side of the garment.

In the final garment, the ends 2*a*, 3*a* are preferably arranged facing one to the other (in a "side-by-side" configuration), i.e. the edges 20*a*, 30*a* of the ends 2*a*, 3*a* are arranged next to the other, substantially in contact one with the other, or with a small distance (less than the width of the stitch 4) one from the other. It is not excluded that, in different embodiments, the ends 2*a*, 3*a* are partially superimposed one to the other, typically only in the region of the garment 1 that is covered by the stitch 4.

The ends 2*a*, 3*a* are preferably substantially coplanar, or parallel (considering a condition where the ends 2*a*, 3*a* are placed on a plane surface). Preferably, if the ends are placed on a horizontal surface, the ends 2*a*, 3*a* are substantially horizontal, too. According to a preferred aspect, the inner side of a first end between the ends 2*a*, 3*a* is not in contact to the inner side of the other end between the ends 2*a*, 3*a*. In other words, according to a preferred aspect, the condition of FIGS. 2A and 2B, where, at the stitch 4, the inner sides of the ends 2*a*, 3*a* are in contact one to the other, occurs only during production, while it does not occur in the final garment, as per FIG. 2B.

A covering element 5, such as a band, ribbon or tape or a similar element can be applied on the outer side 1*b* of the garment 1 to at least partially cover the stitch 4.

For producing a garment 1 according to the invention, the ends 2*a*, 3*a* are joined (i.e. seamed) via one or more threads 4*a* that form a stitch 4.

As mentioned, according to a possible solution, it is possible to perform a cutting operation on the edges 20*a*, 30*a* of the ends 2*a*, 3*a* where the stitch 4 is applied. In particular, the edges 20*a*, 30*a* are preferably cut so that, in the final condition, they are substantially parallel one to the other.

Subsequently, the ends 2*a*, 3*a* are typically mechanically treated (preferably by pulling the ends 2*a*, 3*a* one away from the other) so that the thread(s) 4*a* of the stitch 4 is/are present on both sides of the garment 1. In such a configuration, the ends 2*a*, 3*a* are preferably arranged one facing the other, in a "side-by-side" configuration.

The stitch 4 is applied in "reverse" arrangement, i.e. so that the thicker part of the stitch 4 is placed on the outer side of the garment 1.

Preferably, at least 50%, more preferably at least 70%, most preferably all the overlock stitches that are present on the garment 1 are arranged so that, on the inner side of the garment, the thickness of the stitch is less that the thickness of the same stitch on the outer side of the garment.

According to another preferred aspect, at least 50%, more preferably at least 70%, most preferably all the stitches of the garment 1 are overlock stitch that satisfy the above mentioned condition.

The invention claimed is:

1. A garment (1) having an inner side (1*a*), and an outer side (1*b*) opposite to the inner side (1*a*), the garment (1) comprising one or more woven fabrics (2, 3), wherein at least two ends (2*a*, 3*a*) of different woven fabrics (2, 3) and/or two ends (2*a*, 3*a*) of the same woven fabric are seamed by means of one or more threads (4*a*) that form a stitch (4), wherein said stitch (4) is an overlock stitch (4) and it is arranged so that at least one of said threads (4*a*) is present on the inner side (1*a*) of the garment (1), and at least one of said threads (4*a*) is present on the outer side (1*b*) of the garment (1), the thickness (T1) of the stitch (4) on the inner side (1*a*) of the garment (1) is less than the thickness (T2) of the stitch (4) on the outer side (1*b*) of the garment (1), wherein a thickness (T2) of the stitch (4) on the outer side (1*b*) of the garment (1) is equal to or greater than, 2 times a diameter of said threads (4*a*).

2. The garment (1) of claim 1, wherein said ends (2*a*, 3*a*) are parallel one to the other and said two ends (2*a*, 3*a*) are not in contact with one another.

3. The garment (1) of claim 2, wherein said ends (2*a*, 3*a*) are arranged facing each other, in a "side-by-side" configuration and further comprising a band or ribbon covering the at least part of the stitch (4) on the outer side (1*b*) of the garment (1).

4. The garment (1) of claim 1, wherein said stitch (4) is the stitch 504 of ASTM D-6193.

5. The garment (1) of claim 1, wherein said garment (1) is a pair of trousers.

6. The garment (1) according to claim 1, wherein on the inner side (1*a*) of the garment (1), at least 80% of portions of thread that form the stitch (4), are substantially parallel one to the other.

7. The garment (1) according to claim 6, wherein on the inner side (1*a*) of the garment (1), at least 90% of the thread (4*a*) that form the stitch (4) are substantially parallel one to the other.

8. The garment (1) according to claim 6, wherein on the inner side (1*a*) of the garment (1), all the portions of the thread (4*a*) that form the stitch (4) are substantially parallel one to the other.

9. The garment (1) according to claim 1, wherein on the outer side (1*b*) of the garment (1), at least a portion of a thread of the stitch crosses and passes over another portion of a thread of the stitch.

10. The garment (1) according to claim 1, wherein said overlock stitch (4) is a three threads overlock stitch.

11. The garment according to claim 10, wherein on the outer side (1*b*) of the garment (1), at least a portion of a thread of a first stitch crosses and passes over a portion of a different thread of the stitch.

12. The garment (1) according to claim 10, wherein said overlock stitch (4) is a three threads overlock stitch.

13. The garment (1) according to claim 1, wherein different threads (4*a*) of the stitch (4), or different portions (4*b*) of a thread (4*a*) of the stitch (4), are connected one to the other on the outer side (1*b*) of the garment (1), while they are not connected on the inner side (1*a*) of the garment (1).

14. The garment (1) according to claim 1, wherein at least 50% of the stitches that are present on the garment are overlock stitches provided with one or more threads (4*a*), and configured so that at least one of said thread (4*a*) is present on the inner side (1*a*) of the garment (1), and at least one of said thread (4*a*) is present on the outer side (1*b*) of the garment (1), the thickness (T1) of the stitch (4) on the inner side (1*a*) of the garment (1) is less than the thickness (T2) of the stitch (4) on the outer side (1*b*) of the garment (1).

15. The garment (1) according to claim 14, wherein at least 80% of the stitches that are present on the garment are overlock stitches.

16. The garment (1) of claim 1, wherein said ends (2*a*, 3*a*) are substantially coplanar and are not in contact with one another.

17. A method for producing a garment (1), comprising the steps of:

(a) providing one or more woven fabrics (2, 3);

(b) tailoring the one or more woven fabrics (2, 3) in the shape of a garment (1), said step (b) comprising the step of seaming at least two ends (2*a*, 3*a*) of two woven fabrics (2, 3) or two ends (2*a*, 3*a*) of the same woven fabric joined by means of a stitch (4), wherein said stitch (4) is an overlock stitch and it is arranged so that at least one of said thread (4*a*) is present on the inner side (1*a*) of the garment (1), and at least one of said thread (4*a*) is present on the outer side (1*b*) of the garment (1), the thickness of the stitch (4) on the inner side (1*a*) of the garment (1) is less than the thickness of the stitch (4) on the outer side (1*b*) of the garment (1), wherein during said step of seaming, said two ends (2*a*, 3*a*) are initially superimposed, then moved in opposite direction, along directions that are angled with respect to the stitch direction, until said ends (2*a*, 3*a*) are parallel to one another, to provide said overlock stitch.

18. The method according to claim 17, wherein said step of seaming comprises the thickness (T2) of the stitch (4) on the outer side (1*b*) of the garment (1) being equal or greater than 2 times a diameter of said threads (4*a*).

19. The method according to claim 18, further comprising applying a band or ribbon to cover the at least part of the stitch (4) on the outer side (1*b*) of the garment (1).

20. The method according to claim 17, wherein the edges (20*a*, 30*a*) of the ends (2*a*, 3*a*) where the stitch is applied are cut so that they are parallel one to the other but are not in contact with one another and further comprising applying a band or ribbon to cover the at least part of the stitch (4) on the outer side (1*b*) of the garment (1).

* * * * *